US012498155B2

(12) United States Patent
Lejeune et al.

(10) Patent No.: US 12,498,155 B2
(45) Date of Patent: Dec. 16, 2025

(54) TRANSPORTATION REFRIGERATION UNIT AND METHOD OF MEASURING QUANTITY OF REFRIGERANT IN THE SAME

(71) Applicant: Carrier Corporation, Palm Beach Gardens, FL (US)

(72) Inventors: Maxime Lejeune, Rouen (FR); Marinne Saint-Denis, Ailly (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 123 days.

(21) Appl. No.: 18/325,153

(22) Filed: May 30, 2023

(65) Prior Publication Data

US 2023/0392841 A1 Dec. 7, 2023

(30) Foreign Application Priority Data

Jun. 1, 2022 (EP) ..... 22176856

(51) Int. Cl.
*F25B 45/00* (2006.01)
*F25B 41/20* (2021.01)

(52) U.S. Cl.
CPC ..... *F25B 45/00* (2013.01); *F25B 41/20* (2021.01); *F25B 2345/00* (2013.01); *F25B 2700/04* (2013.01)

(58) Field of Classification Search
CPC ..... F25B 45/00; F25B 41/20; F25B 2345/00; F25B 2700/04; F25B 2400/16; F25B 2700/1933; F25B 2700/197; F25B 49/02; F25B 2400/19; F25B 2500/222; F25B 2600/2519; F25B 41/24; F25B 1/00; F25B 41/31
See application file for complete search history.

(56) References Cited

U.S. PATENT DOCUMENTS

| | | | |
|---|---|---|---|
| 4,794,763 | A | 1/1989 | Kikuchi |
| 5,209,077 | A | 5/1993 | Manz et al. |
| 5,214,918 | A | 6/1993 | Oguni et al. |
| 5,435,145 | A | 7/1995 | Jaster |
| 7,356,998 | B2 | 4/2008 | Lee et al. |
| 9,217,592 | B2 | 12/2015 | Turney et al. |
| 9,459,032 | B2 | 10/2016 | Nishimura et al. |

(Continued)

FOREIGN PATENT DOCUMENTS

| | | | | |
|---|---|---|---|---|
| CN | 1609536 | A * | 4/2005 | ..... F25B 13/00 |
| CN | 101512255 | B * | 5/2011 | ..... F25B 1/10 |

(Continued)

OTHER PUBLICATIONS

Extended European Search Report received for EP Application No. 22176856.7, mailed on Nov. 17, 2022, 05 Pages.

*Primary Examiner* — Kun Kai Ma
(74) *Attorney, Agent, or Firm* — Drew Folgmann

(57) ABSTRACT

A method of measuring the quantity of refrigerant in a refrigeration circuit of a transportation refrigeration unit (TRU). The refrigeration circuit comprises a compressor, a condenser, a receiver, an expansion valve and an evaporator sequentially fluidly connected in a circuit. The method comprises: running the refrigeration circuit in a recovery mode to accumulate the refrigerant in the refrigeration circuit within the receiver; and measuring the quantity of the refrigerant in the refrigeration circuit once it has accumulated within the receiver.

15 Claims, 3 Drawing Sheets

(56) References Cited

U.S. PATENT DOCUMENTS

| | | | | |
|---|---|---|---|---|
| 9,523,523 | B2 | 12/2016 | Sibik et al. | |
| 9,677,799 | B2 | 6/2017 | Ochiai et al. | |
| 9,733,000 | B2 | 8/2017 | Kawano et al. | |
| 9,874,384 | B2 | 1/2018 | Connell et al. | |
| 10,113,896 | B2 | 10/2018 | Toyoshima et al. | |
| 11,067,317 | B2 | 7/2021 | Feria | |
| 11,079,300 | B2 | 8/2021 | Shi et al. | |
| 2020/0232673 | A1 | 7/2020 | Kozasa | |
| 2021/0348811 | A1 | 11/2021 | Shanmugam et al. | |
| 2023/0130167 | A1 * | 4/2023 | Welch | F25B 41/20 62/238.6 |

FOREIGN PATENT DOCUMENTS

| | | | | | |
|---|---|---|---|---|---|
| CN | 103328240 | A | * | 9/2013 | B60H 1/3225 |
| CN | 106091510 | B | | 10/2018 | |
| CN | 113606824 | A | | 11/2021 | |
| DE | 102021203485 | A1 | * | 10/2022 | |
| EP | 1389723 | B1 | | 3/2007 | |
| EP | 1582827 | B1 | | 7/2008 | |
| EP | 2257749 | A2 | | 12/2010 | |
| EP | 2511629 | A4 | | 10/2012 | |
| EP | 2725312 | A2 | | 4/2014 | |
| EP | 1974171 | B1 | | 7/2014 | |
| EP | 3118547 | A1 | | 1/2017 | |
| EP | 1876403 | B1 | | 7/2017 | |
| EP | 3252402 | A1 | | 12/2017 | |
| EP | 3208578 | A4 | | 6/2018 | |
| EP | 2236960 | B1 | | 7/2018 | |
| EP | 2436247 | B1 | | 7/2018 | |
| EP | 3173714 | B1 | | 8/2018 | |
| EP | 2844932 | B1 | | 2/2019 | |
| EP | 2264379 | B1 | | 5/2019 | |
| EP | 3601907 | A1 | | 2/2020 | |
| EP | 3201539 | B1 | | 10/2021 | |
| EP | 3123084 | B1 | | 11/2021 | |
| EP | 3906382 | A1 | | 11/2021 | |
| EP | 3380795 | B1 | | 1/2022 | |
| EP | 3943838 | A1 | | 1/2022 | |
| JP | H01121657 | A | | 5/1989 | |
| JP | H0618130 | A | * | 1/1994 | |
| JP | H09310941 | A | | 12/1997 | |
| JP | 2004125393 | A | * | 4/2004 | |
| JP | 3530208 | B2 | | 5/2004 | |
| JP | 2004183957 | A | * | 7/2004 | B60H 1/00978 |
| JP | 2008157512 | A | * | 7/2008 | |
| JP | 2012117731 | A | * | 6/2012 | |
| JP | 5035024 | B2 | | 9/2012 | |
| JP | 5401806 | B2 | | 1/2014 | |
| WO | 2015198489 | A1 | | 12/2015 | |
| WO | WO-2017218910 | A2 | * | 12/2017 | B60H 1/00771 |

* cited by examiner

TRANSPORTATION REFRIGERATION UNIT AND METHOD OF MEASURING QUANTITY OF REFRIGERANT IN THE SAME

CROSS REFERENCE TO RELATED APPLICATIONS

This application claims priority to European Application No. 22176856.7 filed on Jun. 1, 2022.

FIELD OF THE INVENTION

The present invention relates to a transportation refrigeration unit (TRU) and to a method of measuring the quantity of refrigerant in a refrigeration circuit of the same. The invention further extends to a transportation refrigeration system comprising a TRU and to a cold chain distribution system.

BACKGROUND

Typically, cold chain distribution systems are used to transport and distribute cargo, or more specifically perishable goods and environmentally sensitive goods (herein referred to as perishable goods) that may be susceptible to temperature, humidity, and other environmental factors. Perishable goods may include but are not limited to fruits, vegetables, grains, beans, nuts, eggs, dairy, seed, flowers, meat, poultry, fish, ice, and pharmaceuticals. Advantageously, cold chain distribution systems allow perishable goods to be effectively transported and distributed without damage or other undesirable effects.

Refrigerated vehicles and trailers are commonly used to transport perishable goods in a cold chain distribution system. Conventionally, transportation refrigeration systems (such as refrigerated vehicles and refrigerated trailers) include a transportation refrigeration unit. Such transportation refrigeration units may comprise a refrigeration circuit comprising: a refrigerant compressor, a condenser with one or more associated condenser fans, an expansion device (sometimes termed expansion valve), and an evaporator with one or more associated evaporator fans, which are connected via appropriate refrigerant lines. A receiver may also be positioned in the refrigeration circuit upstream of the expansion valve and downstream of the condenser. The receiver, as is known, acts as an interim storage vessel for liquid refrigerant in the refrigeration circuit prior to its introduction into the evaporator via the expansion device/valve.

The transportation refrigeration unit (TRU) is typically mounted to the vehicle or to the trailer in operative association with a cargo space defined within the vehicle or trailer for maintaining a controlled temperature environment within the cargo space. Air or an air/gas mixture is drawn from the interior volume of the cargo space by means of the evaporator fan(s) associated with the evaporator, passed through the airside of the evaporator in heat exchange relationship with refrigerant whereby the refrigerant absorbs heat from the air, thereby cooling the air. The cooled air is then supplied back to the cargo space to provide refrigeration thereto.

It is advantageous to know the quantity of refrigerant (also termed 'refrigerant charge') within a refrigeration circuit of a TRU. Not only is the amount of refrigerant in the refrigeration circuit tied closely to the performance of the refrigeration circuit, with too much or (more commonly) too little refrigerant resulting in sub-optimal performance of the refrigeration circuit, but it can be important to identify any refrigerant leaks from the refrigerant circuit of a TRU since such leaks may pose a safety risk to personnel in proximity to the TRU.

Known methods for determining the refrigerant charge within a refrigeration circuit of a TRU comprise draining (i.e. removing) all of the refrigerant from the refrigeration circuit and measuring its total quantity once drained. The refrigerant circuit is then recharged with refrigerant, and is optionally topped up (depending on whether the measured refrigerant quantity was sufficient) with additional refrigerant to ensure an optimal level of refrigerant is contained therein.

An improved method for determining the quantity of refrigerant (i.e. refrigerant charge) within the refrigeration circuit of a TRU is desired.

BRIEF SUMMARY

In accordance with a first aspect, there is provided a method of measuring the quantity of refrigerant in a refrigeration circuit of a transportation refrigeration unit (TRU). The refrigeration circuit comprises a compressor, a condenser, a receiver, an expansion valve and an evaporator sequentially fluidly connected in a circuit. The method comprises: running the refrigeration circuit in a recovery mode to accumulate the refrigerant in the refrigeration circuit within the receiver; and measuring the quantity of the refrigerant in the refrigeration circuit once it has accumulated in the receiver.

BRIEF DESCRIPTION OF THE DRAWINGS

Certain embodiments of the invention will now be described, by way of example only, and with reference to the following drawings, in which.

DETAILED DESCRIPTION

Figure 1:
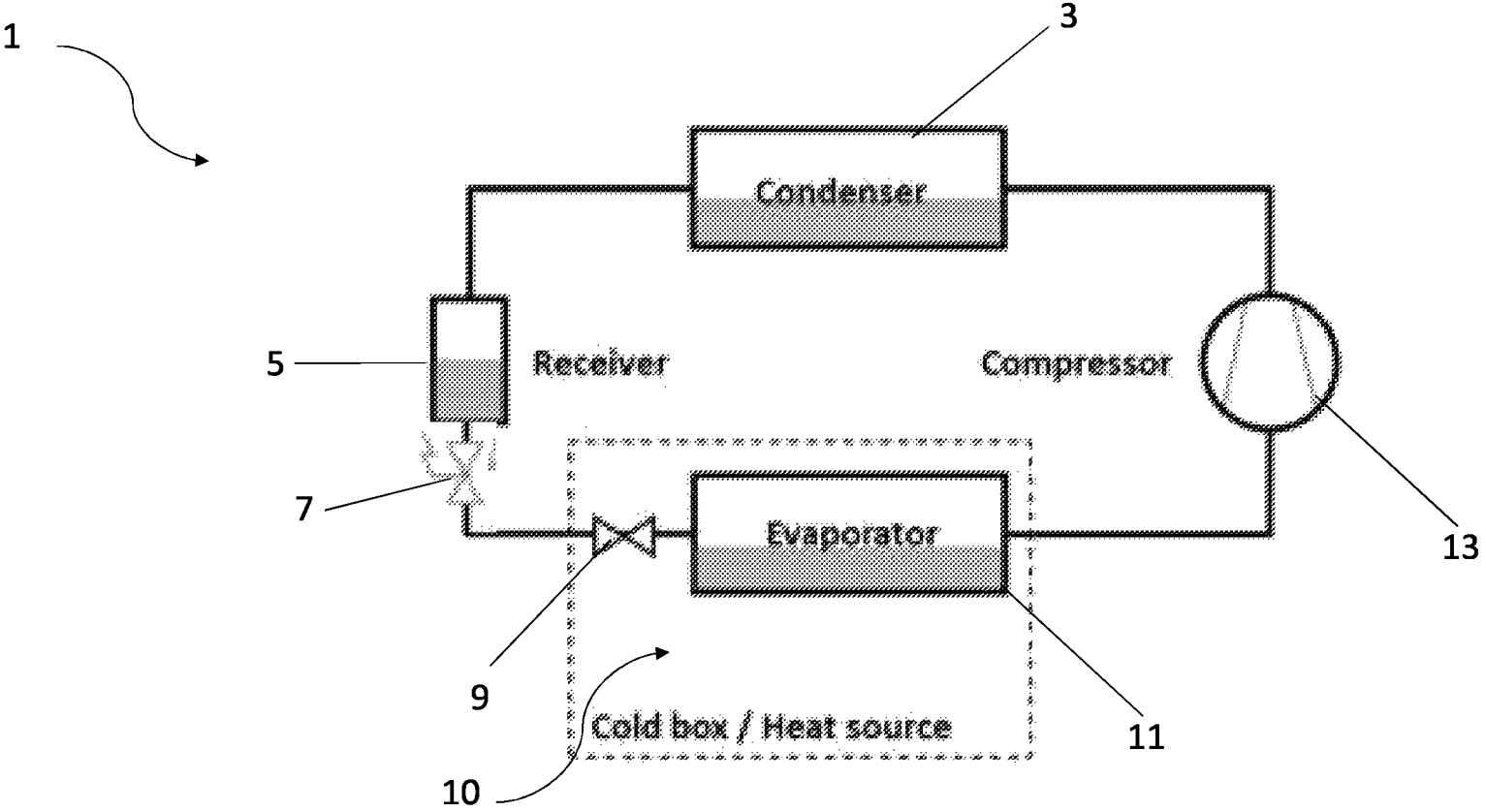
FIG. 1 is a schematic of a refrigeration circuit of a transportation refrigeration unit in an off condition.

The prior art methods known for measuring refrigerating charge of a refrigeration circuit are laborious and time-consuming since they require draining of the refrigerant from the refrigeration circuit. This results in significant downtime of the TRU which is undesirable. As such, these methods for measuring the quantity of refrigerant are not implemented regularly given the associated downtime meaning that there is infrequent knowledge of the refrigerant charge. This can result in sub-optimal performance of the TRU and, perhaps more significantly, result in potentially harmful leaks of refrigerant from the refrigeration circuit being missed.

In contrast, the method of the first aspect permits the determination of the quantity of refrigerant (i.e. the refrigerant charge) within the refrigeration circuit of a transportation refrigeration unit (TRU) without requiring the refrigerant to be drained therefrom as in the known prior art methods. Instead, the method of the first aspect requires that the refrigeration circuit is run in a recovery mode to accumulate the refrigerant within the receiver of the refrigerant circuit where it can be measured to determine its total amount. Consequently, the method of the first aspect is significantly less laborious and time consuming than known prior art methods, and is hence associated with significantly reduced down time of operation of the TRU, and in fact there can effectively be no downtime in operation of the TRU given the speed with which the method of the first aspect can be implemented. This speed and simplicity with which the method of the first aspect can be implemented also means that the determination of the quantity of refrigerant can be determined far more frequently than known prior art methods, which is beneficial as it means that performance of the refrigerant circuit of the TRU can be maintained close to optimal and, perhaps more importantly and as discussed in further detail below, leaks of refrigerant from the circuit can be quickly identified to avoid potential negative effects resulting therefrom.

The method of the first aspect advantageously makes use of the large volume of the receiver to accumulate the refrigerant and thereby permit measurement of its total quantity. The receiver has a volume sufficiently large to permit all refrigerant within the refrigeration circuit to be situated therein whilst it is in the liquid state. As used herein, accumulate, with reference to the refrigerant in the receiver, is intended to mean all the refrigerant or all of the refrigerant but a for a negligible/small amount of the refrigerant in the refrigeration circuit (e.g. remnant refrigerant in the refrigeration lines, condenser, etc.) is accumulated/collected within the receiver.

Whilst a method comprising somewhat similar steps for determining refrigerant charge is known from EP 3201539 B1, the method disclosed in EP 3201539 B1 is in the context of determining charge level in heat pump heating systems for buildings or refrigeration systems for, e.g., supermarkets. There is no disclosure in EP 3201539 B1 of determining refrigerant charge level in a refrigeration circuit of a TRU, and the method therein could not be obviously adapted for use in measuring the refrigerant charge of a refrigeration circuit in a TRU given the unique technical challenges and considerations associated therewith (e.g. considerations and challenges associated with the limited degree of space available, associated with transportation conditions, etc.).

As would be immediately apparent to the skilled person, the refrigeration circuit of the first aspect has a quantity of refrigerant provided therein (i.e. a 'refrigerant charge'). The refrigerant acts as a working fluid to enable the normal functioning and operation of the refrigeration circuit.

As would also be immediately apparent to the skilled person, and particularly given the position of the receiver downstream of the condenser, the refrigerant that accumulates in the receiver during the recovery mode would, in the vast majority, be in liquid form.

By sequentially fluidly connected, it is meant that the compressor, condenser, receiver, expansion valve and evaporator are connected in that order within the circuit with respect to the direction of flow of refrigerant in a cooling mode of operation of the refrigeration circuit. As such, in the cooling mode of operation, refrigerant in the circuit flows from the compressor to the condenser, from the condenser to the receiver, from the receiver to the expansion valve, from the expansion valve to the evaporator, and from the evaporator back to the condenser. It should be noted that the sequential order of these components does not preclude the introduction of additional, optional components (e.g. shutoff valve—more on this below) at intervening positions within the circuit.

The quantity that is measured may be a volume of the refrigerant or a mass of the refrigerant.

The refrigerant may be a Class A or Class B refrigerant in accordance with the ASHRAE Standard 34, 2019. The refrigerant may be a Class 1, 2L, 2 or 3 refrigerant in accordance with the ASHRAE Standard 34, 2019.

More specifically, the refrigerant may be a Class A2L, A2, A3, B2L, B2 or B3 refrigerant in accordance with the ASHRAE Standard 34, 2019. These specific classes of refrigerant, as will be well known to the skilled person, are each associated with at least a degree of flammability. The invention of the first aspect is particularly advantageous in the context of flammable refrigerants since their quantity in the refrigeration circuit can be quickly and easily determined and, consequently, any potential leaks of said refrigerant to the environment, which have potentially harmful effects, particularly in the context of the closed environments that TRUs are commonly associated with (e.g. a cargo space of a transportation refrigeration system), can also be quickly and easily detected as discussed in further detail below.

The refrigerant may be a Class A2L refrigerant in accordance with the ASHRAE Standard 34, 2019, for example a HFO (Hydrofluoroolefin) refrigerant.

The step of running the refrigeration circuit in a recovery mode may comprise: closing the expansion valve; and operating the compressor to drive the refrigerant in the refrigeration circuit to accumulate in the receiver. In addition, or as an alternative, to the step of closing the expansion valve, the step of running the refrigeration circuit in the recovery mode may comprise closing a shutoff valve situated at an outlet of the receiver or in close proximity to the outlet of the receiver. By close proximity, it is meant that the shutoff valve is at least closer to the outlet of receiver along the path of refrigerant flow than the expansion valve.

By closing the shutoff valve and/or expansion valve, refrigerant is prevented from entering the evaporator. As such, operating the compressor whilst the shutoff valve and/or expansion valve is/are closed forces refrigerant in the refrigeration circuit to accumulate in the receiver that is positioned upstream of the shutoff valve and/or expansion valve. Thus, substantially all refrigerant in the refrigeration circuit between the shutoff valve and/or expansion valve and the inlet of the compressor is removed when the refrigeration circuit is run in the recovery mode. Some remnant refrigerant in a gaseous state may remain in the portion of the refrigeration circuit between the shutoff valve/expansion valve and the inlet of the compressor, but its quantity will be negligible as compared to the total quantity of refrigerant in the circuit and thus it will not affect the quantity of refrigerant measured at the receiver.

Whilst, as above, solely the expansion valve may be closed during the recovery mode, it is advantageous to close a shutoff valve situated at the outlet of the receiver during this step (either in addition to or instead of closing the expansion valve) particularly in scenarios where the refrigerant used has a degree of flammability. Typically, but not necessarily, the expansion valve of the circuit would be situated proximate the inlet of the evaporator which, in use, would typically be provided proximate and in communication with an enclosed environment, such as a cargo space defined in a transportation refrigeration system. Thus, by relying on the expansion valve solely for the recovery mode, potentially flammable refrigerant may be left in proximity to the enclosed cargo space and may even leak therein in the eventuality of a leak in the refrigerant lines between the receiver and the expansion valve. This is not desirable. Therefore, by providing and closing a shutoff valve situated at the outlet of the receiver and which would be spaced from (i.e. outside of) a cargo space then any risk (e.g. a fire risk if the refrigerant is flammable) posed by refrigerant being present near or in a cargo space can be avoided.

A one-way valve may be situated at an outlet of the compressor. The one-way valve may permit flow of refrigerant from the compressor to the condenser. The one-way valve may prevent refrigerant from flowing back through the compressor. In particular, the one-way valve may prevent refrigerant from flowing back through the compressor during the recovery mode of operation.

A pressure sensor may be provided in fluid communication with the refrigeration circuit between an inlet of the compressor and the expansion valve or the shutoff valve (if present). The pressure sensor may be configured to measure the pressure in the refrigeration circuit between an inlet of the compressor and the shutoff valve or the expansion valve. Subsequent to the optional step of operating the compressor to drive the refrigerant to accumulate in the receiver (which is optionally comprised as part of the step of running the refrigeration circuit in a recovery mode), the method may comprise ceasing operation of the compressor if a pressure measured by the pressure sensor is less than a threshold pressure. The threshold pressure may be selected to correspond to a pressure indicative of all refrigerant (other than perhaps a negligible amount) having been removed from the portion of the refrigeration circuit between the closed expansion valve/shutoff valve and the inlet of the compressor, and hence is equally indicative of all refrigerant in the refrigeration circuit (other than perhaps a negligible amount) having accumulated in the receiver.

The step of measuring the quantity of refrigerant within the receiver may comprise measuring the quantity of refrigerant with a liquid level sensor disposed in operative association with the receiver.

The liquid level sensor may be a float-type liquid level sensor, for example a horizontal float-type liquid level sensor comprising a float disposed on a pivotally supported arm. Alternatively, it may be a vertical float-type liquid level sensor comprising a float mounted on a vertical guide member. Float-type liquid level sensors are advantageously cheap.

The liquid level sensor may be a float-less type liquid level sensor. For example, the liquid level sensor may be a pressure transmitter liquid level sensor or an ultrasonic transmitter liquid level sensor.

The step of measuring the quantity of refrigerant within the receiver may comprise viewing (by an operative) the quantity of refrigerant within the receiver, optionally via a window provided in the receiver. The window may be provided with a marking or markings that (each) mark a given fixed volume within the receiver and hence may assist in permitting the operative to measure the quantity of refrigerant.

The refrigeration circuit may comprise one or more condenser fans associated with the condenser and configured to draw air over the condenser and/or one or more evaporator fans associated with the evaporator and configured to draw air over the evaporator.

As will be readily apparent to the skilled person, the components of the refrigeration circuit (i.e. the condenser, the receiver, the expansion valve and the evaporator) will be connected in a closed refrigerant circuit via appropriate refrigerant lines/conduits.

The transportation refrigeration unit may comprise a controller in communication with the components (e.g. the expansion valve, the optional shutoff valve, the optional pressure sensor, the optional liquid level sensor the condenser, the evaporator, the compressor and/or the receiver) of the refrigeration circuit. The controller may control operation of the components of the refrigeration circuit. For example, in the recovery mode, the controller may control operation of the compressor and control the shutoff valve and/or the expansion valve to close. The controller may control the compressor to stop operating during the recovery mode in response to receiving a signal from the pressure sensor that the pressure is below a threshold pressure. The controller may receive a signal from the liquid level sensor indicating the measured quantity of refrigerant within the receiver. The controller may then communicate this measured quantity to an operative.

The transportation refrigeration unit, as will be implicit from the above description, may be arranged to cool and/or refrigerate a cargo space of a transportation refrigeration system with the refrigeration circuit. As such, the method of the first aspect may comprise, prior and/or or subsequent to the steps of running the refrigeration circuit in a recovery mode and measuring the quantity of refrigerant, cooling and/or refrigerating a cargo space of a transportation refrigeration system. The step(s) of cooling and/or refrigerating may comprise: drawing air or an air gas mixture from the interior volume of the cargo space, optionally by means of the evaporator fan(s) associated with the evaporator, passing the air or the air gas mixture through an airside of the evaporator in heat exchange relationship with refrigerant whereby the refrigerant absorbs heat from the air or the air gas mixture to thereby cool the air or the air gas mixture; and supplying the cooled air back to the cargo space. The heated refrigerant may then be supplied from the evaporator to the compressor where it is compressed before being sent to the condenser where it is cooled and substantially condensed into a liquid. The cooled and (primarily) liquid refrigerant may then be supplied to the receiver for interim storage before being supplied, optionally via the shutoff valve, via the expansion valve, which depressurises the refrigerant, to the evaporator to be used for cooling and/or refrigerating the air in the cargo space again.

The transportation refrigeration unit may be mounted/attached to a transportation refrigeration system (e.g. a vehicle or a refrigerated trailer) and may be in operative association with a cargo space defined within the transportation refrigeration system. The transportation refrigeration unit may be configured to cool/refrigerate and/or maintain a controlled temperature environment within the cargo space. This may be in accordance with those steps of cooling and/or refrigerating as discussed above. Specifically, the refrigerant circuit may be configured to refrigerate a cargo space/refrigeration volume of a transportation refrigeration system. The cargo space may be a temperature controlled volume for storage and transport of perishable goods.

The method may comprise using and/or providing a transportation refrigeration unit as described herein The method may comprise providing a transportation refrigeration system, and attaching/mounting the transportation refrigeration unit to the transportation refrigeration system. The transportation refrigeration unit may be attached/mounted to the transportation refrigeration system such that it is in operative association with a cargo space therein and such that it is configured to refrigerate/cool the cargo space. The transportation refrigeration system may be a refrigerated vehicle, e.g. a refrigerated light goods vehicle or heavy goods vehicle. The transportation refrigeration system may be a refrigerated trailer, e.g. a refrigerated trailer of a heavy goods vehicle.

In a second aspect, the invention provides a method of determining a leak of refrigerant from a refrigeration circuit of a transportation refrigeration unit (TRU), the method comprising: measuring the quantity of refrigerant in a refrigeration circuit of the TRU in accordance with the first aspect of the invention, optionally in accordance with any optional form thereof; and determining a leak if the measured quantity of refrigerant is below a setpoint.

The method of the second aspect permits leaks of refrigerant to be determined/identified, which is particularly advantageous in the optional context of flammable refrigerants (i.e. Class A2L, A2, A3, B2L, B2 or B3 refrigerants) since fires and possible explosions can be avoided which may otherwise result if the leak was not identified/determined.

In a particularly advantageous embodiment, the transportation refrigeration unit of the second aspect may be one that is arranged to cool and/or refrigerate a cargo space of a transportation refrigeration system with the refrigeration circuit, and the refrigerant may one of a A2L, A2, A3, B2L, B2 or B3 refrigerant. The method of the second aspect is particularly advantageous in such a context as the fire risk resulting from a leak of flammable refrigerant going undetected (i.e. without the method of the second aspect being implemented) is particularly significant given the closed environment (i.e. cargo space) in which the leak may occur.

The step of determining a leak may be carried out by the optional controller as discussed above in relation to the first aspect of the invention.

The setpoint may be an expected quantity of refrigerant within the refrigeration circuit. The expected quantity of refrigerant may be the quantity of refrigerant that the refrigeration circuit was initially charged with or the quantity of refrigerant previously measured as being present in the refrigeration circuit in a previous implementation of the method of the first aspect. The expected quantity of refrigerant may be the quantity of refrigerant that the refrigeration circuit was initially charged with or the quantity of refrigerant previously measured subject to some tolerable and expected losses of refrigerant from the refrigeration circuit due to its normal operation over time.

Responsive to determination of a leak, the method of the second aspect may comprise maintaining the shutoff valve and/or expansion valve in a closed condition. In that way, refrigerant (which may cause a fire risk if flammable) is prevented from passing downstream of the shutoff valve/expansion valve and potentially leaking into a cargo space with which the TRU may be associated with. Thus, any fire risk caused by the initial leak of refrigerant, for example into the cargo space, may be prevented from increasing. As discussed above, it is particularly advantageous in terms of negating fire risk to maintain the shutoff valve in a closed condition responsive to determination of leak since this ensures that refrigerant (that may be flammable) is maintained away from any enclosed environment (e.g. cargo space) which the evaporator may be in communication with.

Responsive to determination of a leak, the method of the second aspect may comprise de-energising the TRU and/or the refrigeration circuit. De-energising the TRU and/or refrigeration circuit suppresses possible ignition sources for any leaked refrigerant (in the event that said refrigerant is flammable) and thereby further reduces the risk of a fire.

In a third aspect of the invention, there is provided a transportation refrigeration unit (TRU) comprising a refrigeration circuit, the refrigeration circuit comprising a compressor, a condenser, a receiver, an expansion valve and an evaporator sequentially fluidly connected in a circuit, wherein the refrigeration circuit is configured to be run in a recovery mode to accumulate the refrigerant in the refrigeration circuit within the receiver; and wherein the refrigeration unit is arranged to permit measurement of the quantity of the refrigerant in the refrigeration circuit once it has accumulated within the receiver.

The transportation refrigeration unit and/or the refrigeration circuit of the third aspect may be in accordance with the transportation refrigeration unit and/or the refrigeration circuit discussed above in relation to the first and/or second aspects, optionally in any optional forms thereof.

In a fourth aspect of the invention, there is provided a transport refrigeration system comprising the transportation refrigeration unit of the third aspect, optionally in accordance with any optional form thereof.

The transportation refrigeration system as discussed in relation to any of the above aspects may be a refrigerated vehicle, e.g. a refrigerated light goods vehicle or heavy goods vehicle. The transportation refrigeration system may be a refrigerated trailer, e.g. a refrigerated trailer of a heavy goods vehicle.

In a fifth aspect, there is provided a cold chain distribution system comprising one or more transportation refrigeration systems in accordance with the fourth aspect of the invention, optionally inclusive of any optional features thereof.

FIG. 1 shows a refrigeration circuit 1 of a transportation refrigeration unit (TRU). The refrigeration circuit 1 comprises a condenser 3, a receiver 5, a shutoff valve 7 situated at the outlet of the receiver, an expansion valve 9 situated proximate the inlet of an evaporator 11, the evaporator 11 and a condenser 13 sequentially fluidly connected in a circuit via appropriate refrigeration lines. As is shown, the evaporator 11 is in operative association with a cargo space 10 of a transport refrigeration system (e.g. a refrigerated trailer) and is configured to provide refrigeration thereto as will be described in further detail below with reference to FIG. 2.

FIG. 1 shows the refrigeration circuit 1 in a standby or off mode, whereby the components (and in particular the compressor 13) of the refrigeration circuit 1 are not operating. As such, refrigerant in the refrigeration circuit 1 is not being driven around the circuit 1 but instead sits stationary in the various components of the refrigeration circuit 1 (as shown by the shaded regions of the various components)

Figure 2:
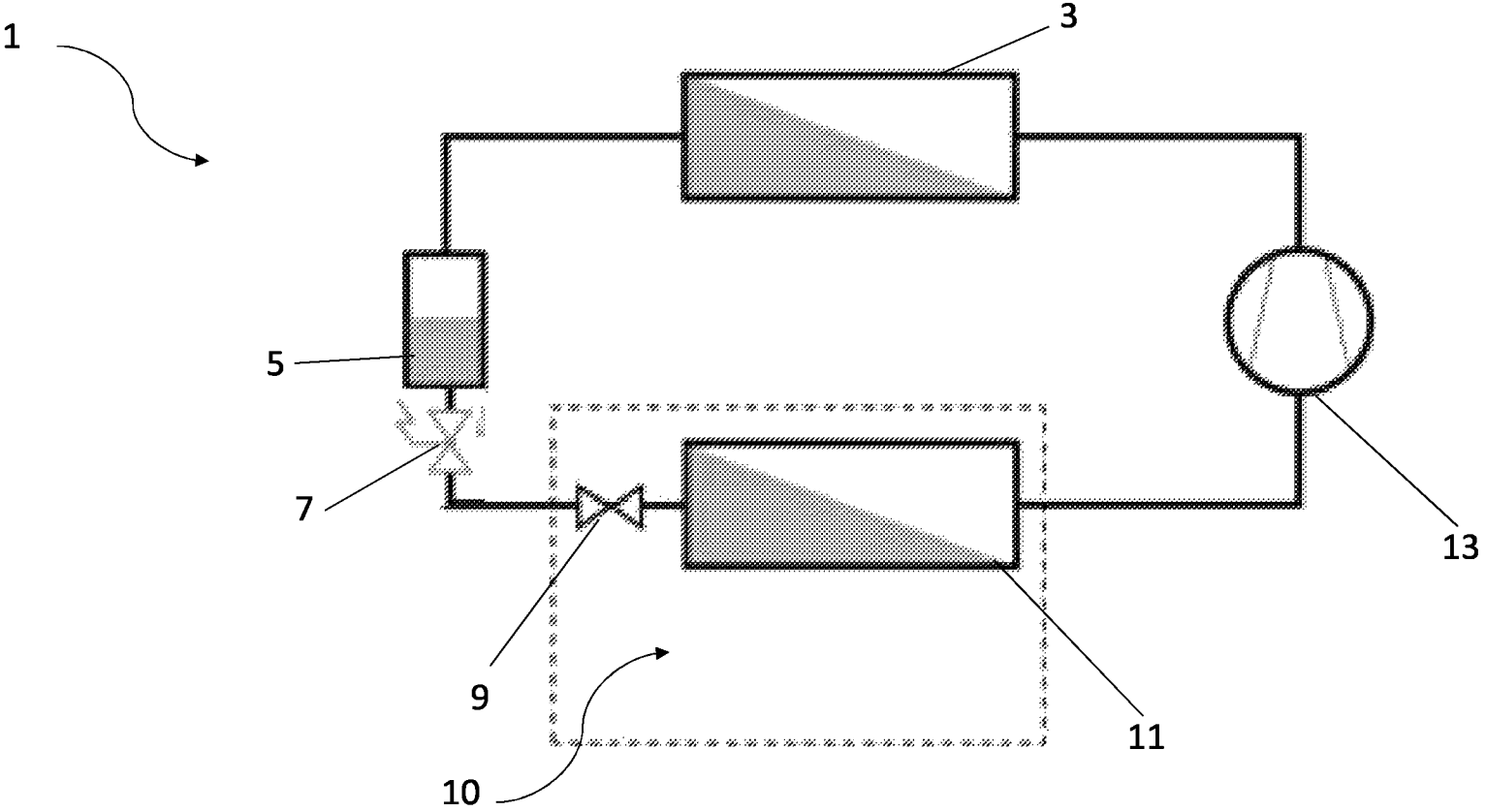
FIG. 2 is a schematic of the same refrigeration circuit of FIG. 1 operating in a cooling mode.

FIG. 2 shows the refrigeration circuit 1 in a cooling mode of operation. In this mode of operation, the compressor 13 is operating to drive refrigerant around the refrigerant circuit 1. Specifically, pressurized gaseous refrigerant leaves the compressor 13 and is sent to the condenser 3. Herein, the refrigerant is placed into a thermal heat exchange with external air flowing over the condenser 3 causing the gaseous refrigerant to condense and liquefy therein. Subsequent to this, the liquid refrigerant is supplied from the condenser 3 (under the impetus provided by the compressor 13) to the receiver 5, where the liquid refrigerant is temporarily stored before being supplied via the shutoff valve 7, which is in an open state during the cooling mode, to the expansion valve 9. The expansion valve 9 depressurizes the refrigerant and permits its supply to the evaporator 11. In the evaporator 11, the refrigerant is placed into heat exchange relationship with air from the cargo space 10 being passed over the evaporator 11 and absorbs heat therefrom to cool the air in the cargo space 10 and provide refrigeration thereto. The heated gaseous refrigerant is then supplied from the evaporator 11 to the compressor 13, where it is pressurized and passed around the refrigerant circuit 1 again for continued cooling of the cargo space 10.

Figure 3:
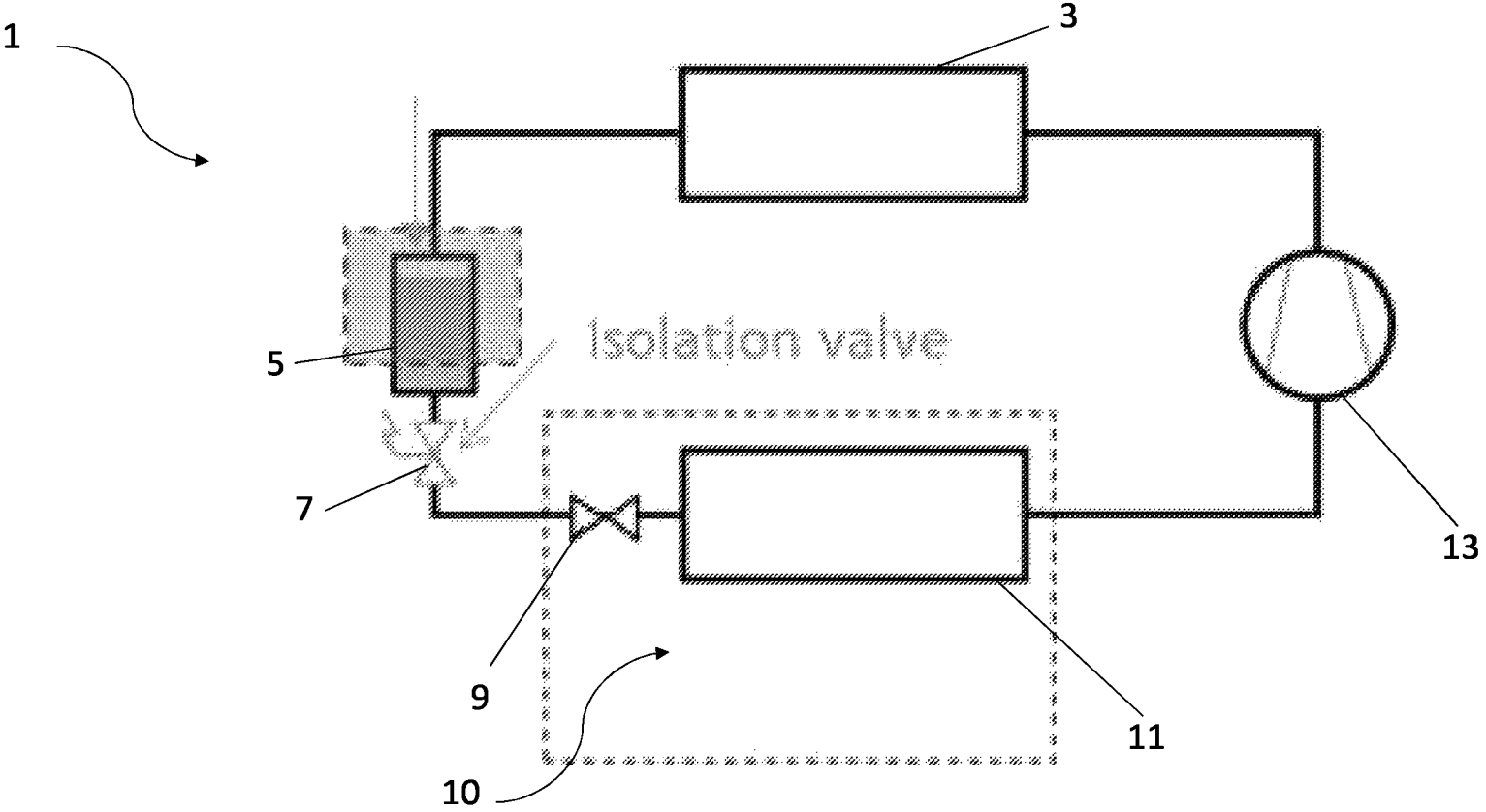
FIG. 3 is a schematic of the same refrigeration circuit of FIG. 1 operating in a recovery mode.

FIG. 3 shows the refrigeration circuit 1 operating in a recovery mode that is used in a method of measuring the quantity of refrigerant within the refrigeration circuit 1. The recovery mode comprises closing the expansion valve 9 and the shutoff valve 7 and simultaneously comprises operating the compressor 13. This causes refrigerant in the refrigeration circuit to be driven into the receiver 5 where it accumulates therein in liquid form.

The compressor 13 is operated whilst the refrigeration circuit 1 is in the recovery mode of operation until a predetermined condition is met indicative of all of the refrigerant within the refrigerant circuit 1 having accumulated in the receiver 5. The predetermined condition may, for example, be a pressure measured using a pressure sensor (not shown), which is in communication with the refrigeration circuit at a position between the expansion valve 9 and compressor 13, falling below a predetermined threshold. The predetermined condition may be indicative of all, or all but a negligible quantity of refrigerant, having been removed from that portion of the refrigeration circuit 1 and thereby all, or all but a negligible quantity of refrigerant having been accumulated in the receiver 5.

Once the compressor 13 ceases operation, a measurement of the refrigerant quantity accumulated (see the shaded region in the receiver 5 of FIG. 3) within the receiver 5 is made. This is carried out using a liquid level sensor (not shown) situated within the receiver 5.

The measurement from the liquid level sensor gives a measurement of the total quantity of refrigerant within the refrigeration circuit 1 given all (or all but a negligible amount) of the refrigerant is present in the receiver 5.

From this measurement, a determination can then be made as to whether the quantity of refrigerant is appropriate for the refrigerant circuit 1 and whether additional refrigerant needs to be added to the refrigeration circuit 1 based on the measured quantity and knowledge of the desired amount of refrigerant for optimal performance. An appropriate quantity of refrigerant may then be added to the refrigeration circuit 1 as appropriate.

Based on the measured quantity of refrigerant, a leak from the refrigeration circuit 1 can be determined/identified as a consequence. Specifically, the measured quantity of refrigerant in the receiver 5 can be compared with a setpoint indicative of an expected quantity of refrigerant within the refrigeration circuit 1. If the measured quantity of refrigerant falls below (i.e. does not exceed or match) the expected quantity of refrigerant, then it can be determined there is a leak. Responsive to the leak, the shutoff valve 7 (and optionally the expansion valve 9) can be maintained in the closed condition, and the refrigeration circuit 1 and the remainder of the TRU can be de-energized. In that way, and in the eventuality that the refrigerant used is flammable, the fire risk associated with the leak is significantly reduced. This is because refrigerant is prevented from leaking into the enclosed environment that is the cargo space 10 since the shutoff valve 7 situated at the outlet of the receiver and spaced from the cargo space 10 is in the closed condition. Moreover, possible sources of ignition that would otherwise be present from operation of the TRU/refrigeration circuit 1 are removed via the de-energization that takes place.

The invention claimed is:

1. A method of measuring the quantity of refrigerant in a refrigeration circuit of a transportation refrigeration unit (TRU), the refrigeration circuit comprising a compressor, a condenser, a receiver, an expansion valve and an evaporator sequentially fluidly connected in the refrigeration circuit, the method comprising:

running the refrigeration circuit in a recovery mode to accumulate the refrigerant in the refrigeration circuit within the receiver, wherein the step of running the refrigeration circuit in a recovery mode further comprises:

closing a shutoff valve situated at or in close proximity to an outlet of the receiver and/or closing the expansion valve;

operating the compressor to drive the refrigerant to accumulate in the receiver;

stopping operation of the compressor in response to a pressure upstream of the inlet of the compressor and downstream of the closed shutoff valve or the closed expansion valve is less than a threshold pressure; and measuring the quantity of the refrigerant in the refrigeration circuit once the quantity of the refrigerant has accumulated in the receiver.

2. The method as claimed in claim 1, wherein the step of measuring the quantity of refrigerant comprises measuring the quantity of refrigerant with a liquid level sensor disposed in operative association with the receiver.

3. The method as claimed in claim 2, wherein the liquid level sensor is a float-type liquid level sensor.

4. The method as claimed in claim 3, wherein the liquid level sensor is a horizontal float-type liquid level sensor comprising a float disposed on a pivotally supported arm.

5. The method as claimed in claim 3, wherein the liquid level sensor is a vertical float-type liquid level sensor comprising a float mounted on a vertical guide member.

6. The method as claimed claim 1, wherein the refrigerant is a Class A2L, A2, A3, B2L, B2 or B3 refrigerant in accordance with the ASHRAE Standard 34, 2019.

7. The method as claimed in claim 6, wherein the refrigerant is a Class A2L refrigerant in accordance with the ASHRAE Standard 34, 2019.

8. A method of determining a leak of refrigerant from a refrigeration circuit of a transportation refrigeration unit (TRU), the method comprising:

measuring a quantity of refrigerant in the refrigeration circuit in accordance with claim 1; and determining a leak if the measured quantity is below a setpoint.

9. The method as claimed in claim 8, wherein, responsive to a leak being determined, the method comprises:

maintaining a shutoff valve at the outlet of the receiver and/or the expansion valve in a closed condition; and/or de-energizing the TRU and/or the refrigeration circuit.

10. A transportation refrigeration unit (TRU) comprising:

a refrigeration circuit, the refrigeration circuit comprising: a compressor, a condenser, a receiver, an expansion valve and an evaporator sequentially fluidly connected in the refrigeration circuit; and a controller, the controller configured to control the refrigeration circuit to:

run in a recovery mode to accumulate the refrigerant in the refrigeration circuit within the receiver; and stop operation of the compressor during the recovery mode in response to receiving a signal from a pressure sensor that a pressure is below a threshold pressure, wherein the pressure is based on, at least in part, a pressure downstream of a shutoff valve or an expansion valve.

11. A transportation refrigeration system comprising a TRU in accordance with claim 10.

12. A cold chain distribution system comprising at least one transportation refrigeration system in accordance with claim 11.

13. The transportation refrigeration unit (TRU) as claimed in claim 10, wherein the TRU is further configured to permit measurement of the quantity of the refrigerant in the refrigeration circuit once the quantity of the refrigerant has accumulated in the receiver.

14. The transportation refrigeration unit (TRU) as claimed in claim 10, wherein the pressure is based on, at least in part, a pressure upstream of an inlet of the compressor.

15. The transportation refrigeration unit (TRU) as claimed in claim 10, wherein the pressure is based on, a pressure upstream of an inlet of the compressor and downstream of a closed shutoff valve or a closed expansion valve.

* * * * *